United States Patent [19]

Greenlees

[11] 3,986,394

[45] Oct. 19, 1976

[54] METHOD OF TESTING AIR TARGET FUZING SYSTEMS

[75] Inventor: William D. Greenlees, Accokeek, Md.

[73] Assignee: The United States of America as represented by the Secretary of the Navy, Washington, D.C.

[22] Filed: Oct. 9, 1975

[21] Appl. No.: 621,182

[52] U.S. Cl. ..... 73/167; 343/17.7

[51] Int. Cl.[2] ..... G01N 33/22

[58] Field of Search ..... 73/5, 35, 167; 343/17.7

[56] References Cited

UNITED STATES PATENTS 2,977,590 3/1961 Lovick ..... 73/167 X 3,719,077 3/1973 Haupt et al. ..... 73/167

*Primary Examiner*—James J. Gill

*Attorney, Agent, or Firm*—R. S. Sciascia; Paul S. Collignon

[57] ABSTRACT

A method of testing air target fuzing systems by moving a simulated target past stationarily mounted fuzes and fuzed warheads. A simulated target is fired from a large gun past one or more fuzes and/or fuzed warheads and the encounter between the simulated target and the fuzes is recorded on film and magnetic tape to provide a permanent record.

15 Claims, 6 Drawing Figures

METHOD OF TESTING AIR TARGET FUZING SYSTEMS

BACKGROUND OF THE INVENTION

The present invention relates to a method for testing fuzes and fuzed warheads and more particularly to a method of testing proximity fuzes against simulated targets which are traveling at high velocity.

Heretofore, there has not been any relatively inexpensive way to test proximity fuzes against moving targets. One expensive way to test fuzes and fuzed warheads has been to fire a fuzed projectile at an air target, such as a drone. This method, however, has several disadvantages. If the target is hit and destroyed, the test is very expensive due to the high cost of the drone, however, very little, if any, test data is realized from this type of test. On the other hand, in the event the projectile misses the drone, the projectile is normally never recovered and there is not any information available as to the reason for the miss.

SUMMARY OF THE INVENTION

The present invention relates to a method of testing fuzes and more particularly to a method of testing promixity fuzes against a moving target.

When a projectile or missile is fired at an air target, both vehicles are moving. When the missile and target travel in opposite, or headon, directions, the relative velocity, called closing velocity, is a sum of the velocities for each vehicle. In the present test method, a fuze is stationarily mounted on a high tower and a simulated target is fired from a gun and has a velocity comparable to a closing velocity. Information from the fuze is channeled to a tape record and, in addition, motion pictures are taken of the firing to provide a permanent record of fuze action. In the event of a malfunction, the fuze is available for examination and the source of trouble can be analyzed.

It is therefore a general object of the present invention to provide a relatively inexpensive method of testing proximity fuzes, which method permits recording of reliable performance data for the fuze.

Other objects, advantages and novel features of the present invention will become apparent from the following detailed description of the invention when considered in conjunction with the accompanying drawing.

DESCRIPTION OF THE PREFERRED EMBODIMENT

Figure 1:
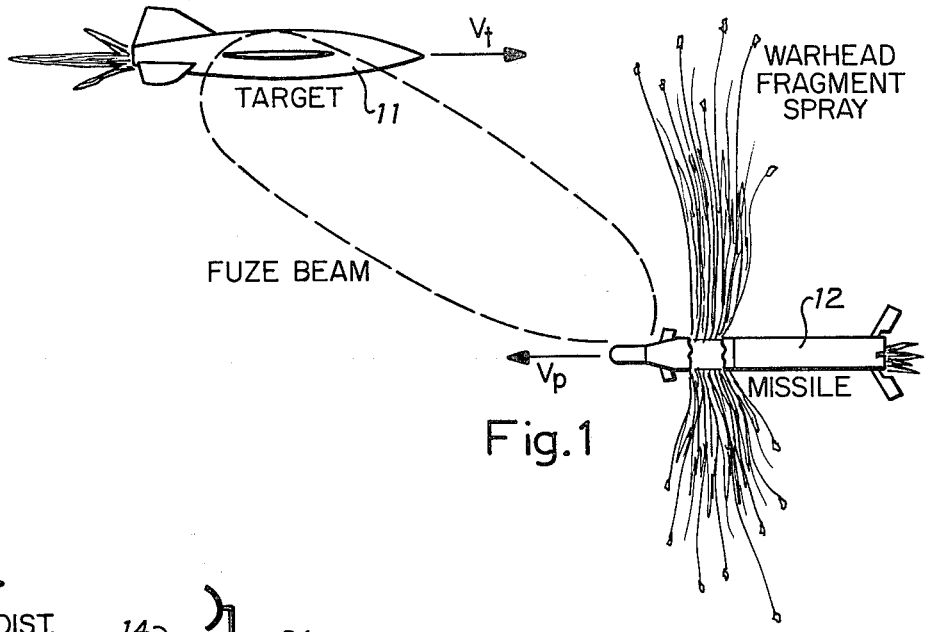
FIG. 1 is a schematic view showing an air weapon encountering an air target.

Referring now to the drawing, and particularly to FIG. 1, there is shown a typical air encounter of a target 11 by a rocket, projectile or guided missile 12. By way of example, a rocket is a missile which is propelled by the reaction of a discharging jet of gas at high velocity, and consists essentially of a head, an engine and a stabilizing fin. The head contains the elements necessary to produce the desired effect upon the target - usually an explosive filler and a fuze.

Aircraft rockets, missiles and gun-fired projectiles use a proximity fuze which is actuated by some characteristic feature of the target or target area. The subject of proximity fuzes represents a broad area of applications, for it is evident that there are a number of ways by which a projectile or missile may ascertain its proximity to a target, that is, by employing high-frequency radio or radar waves, infrared or heat waves, visible light, acoustic waves, and by utilizing other physical properties such as magnetic and electrostatic effects. One important proximity fuze is the radio type which is, in effect, a miniature radar comprised of a radio-frequency transmitter and receiver, plus certain computing and arming circuits.

As depicted in FIG. 1 of the drawing, target 11 is traveling at a velocity of $Vt$ and a projectile or missile 12 is traveling toward target 11 at a velocity of $Vp$. The closing velocity, $Vc$ is then seen to be:

$$Vc = Vt + Vp. \quad (1)$$

Figure 2:
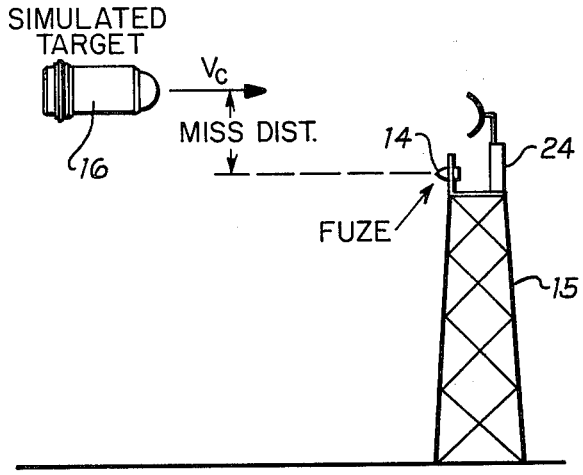
FIG. 2 is a side view showing a simulated target about to encounter a stationary fuze.

Experience has shown that values for $Vc$ range between about 3000–6000 feet per second and, as shown in FIG. 2 of the drawing, as the present invention stationarily mounts fuze 14 on a tower 15, the value for $Vp$ is zero, and $$Vc = Vt. \quad (2)$$

If simulated target 16 is to be a viable target, the encounter closing velocity, $Vc$, should be at least 3000 fps and velocities up to 6000 fps are desired.

Figure 4:
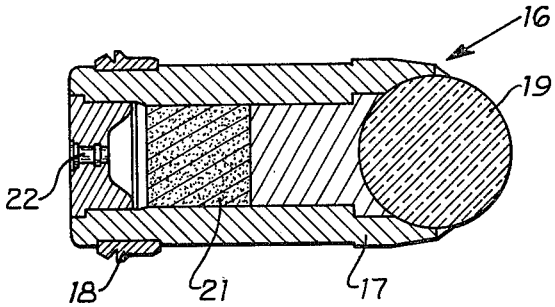
FIG. 4 is a sectional view of a simulated target.

Referring now to FIG. 4 of the drawing, there is shown a simulated target 16 which is designed to be fired from a large gun, such as either an 8-inch or 16-inch Naval gun. Simulated target 16 has a casing 17 which is provided with a copper rotating band 18, and a reflective device, such as a Luneburg lens 19, is provided in the nose to enhance detection of target 16. It should be understood, of course, that other devices could readily be mounted in the forward end of target 16. For example, a flare could be provided which will emit in either, or both, a visible and an infrared range, or a countermeasure device meant to confuse an interceptor could be provided in the nose.

In FIG. 4 of the drawing, there is shown a supply of propellant 21 within casing 17 and, upon ignition, propellant 21 burns and the hot gases which are generated, exit through orifice 22 to give an additional velocity to target 16. If the muzzle velocity of the gun employed provides sufficient velocity to the simulated target 16, simulated target 16 can be made without the necessity of having a chamber, propellant charge, and orifice, and thus would be more economical to produce.

Figure 3:
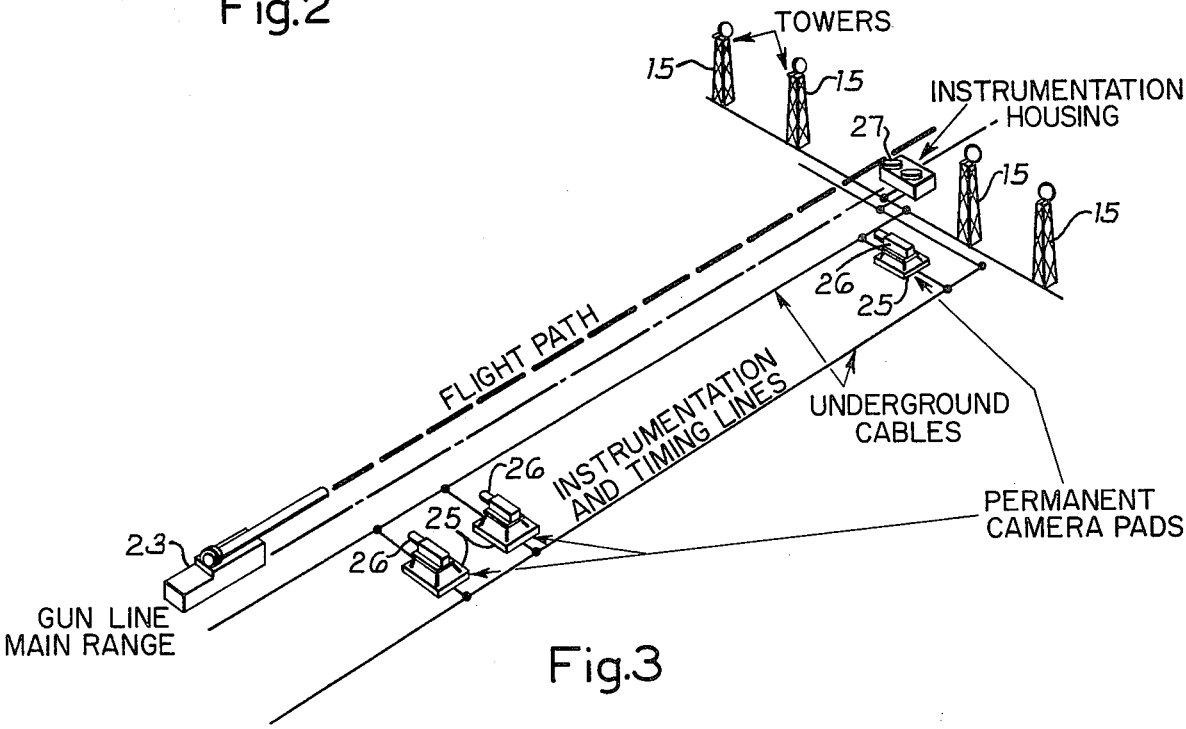
FIG. 3 is a plan view of a gun range for testing fuzes.

Referring now to FIG. 3 of the drawing, there is shown a firing range utilizing the teachings of the present invention. A large gun 23, such as an 8-inch or 16-inch Naval gun is positioned to fire toward a plurality of towers 15. For purposes of illustration, four towers are shown, however, more or less could be employed. Towers 15 can either be stationary or preferably, in order to provide more flexibility to the system, are made movable so that different parameters can be tested. As shown in FIG. 2 of the drawing, a fuze to be tested is mounted on a tower 15, and the position of orientation of the fuze with respect to the on-coming simulated target 16 can also be varied, as a fuze will not always be in a headon orientation. It can thus be seen that the system can be made very versatile to simulate various conditions which prevail in a combat situation.

A radar 24 can be mounted on one or more of the towers 15 and provides data which is recorded in order to confirm that the simulated target 16 presents an adequate representation of an actual target. For example, in order to represent a viable target, for many fuzes the simulated target should present a radar cross section of predetermined size. Assuming that during a test, a fuze failed to respond, if the recorded confirmation radar presentation shows an inadequate radar cross section of the simulated target, then a failure can be attributed to a deficiency in the target and not in the fuze.

Referring again to FIG. 3 of the drawing, there is shown three camera pads 25 each having a camera 26 mounted thereon. Also there is an instrumentation housing 27 for locating recorders which are connected with fuzes and the reference radars. It is desirable that the tape used in the recorders and the film used in the camera be marked with timing signals so that, in analysis, all records will be correlated as to time. Thus, for example, when a tape would show an encounter, or lock-on, of a target 16, each film could be reviewed to determine the exact position of the target when the initial encounter occurred. Thus a complete position review could be made to determine what occurred and when it occurred.

Figure 5:
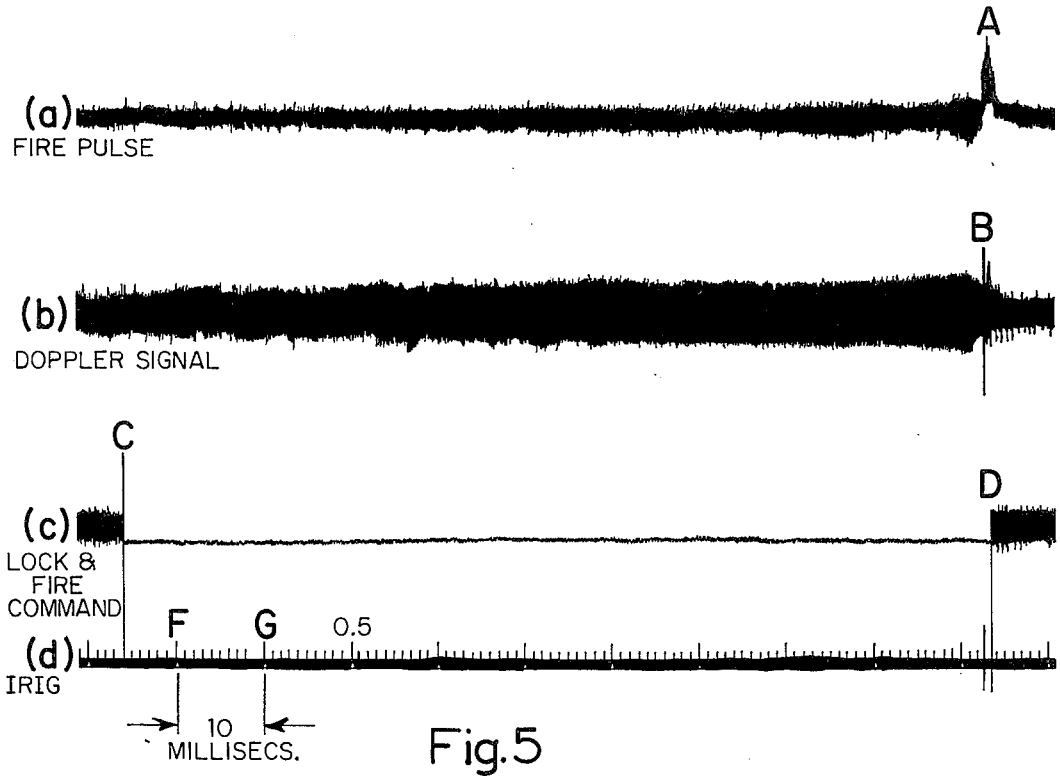
FIG. 5 illustrates traces made by a high speed magnetic tape recorder showing fuze-target engagement.
Figure 6:
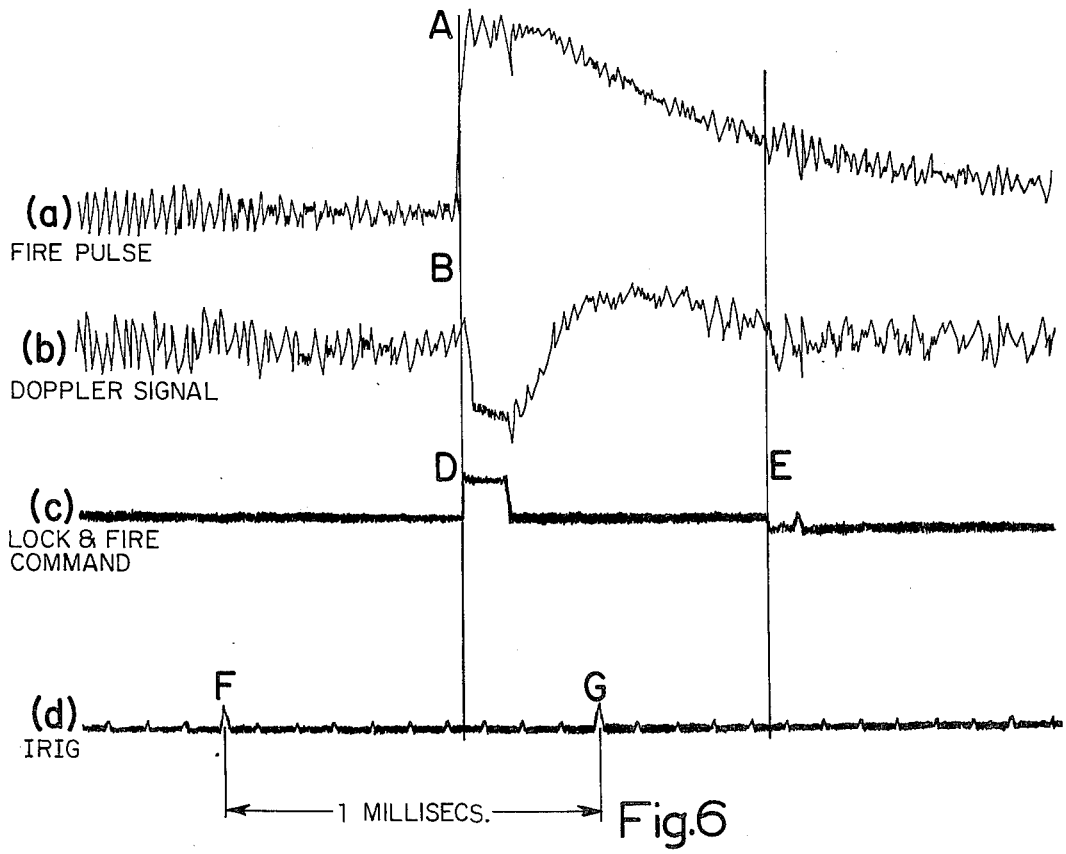
FIG. 6 shows traces similar to those in FIG. 5, only using an expanded time base.

Referring now to FIGS. 5 and 6 of the drawings, there is depicted data from an actual fuze testing using the techniques of the present invention. FIG. 5 is a visual record taken from high speed magnetic tape and shows fuze-target engagement. FIG. 5*a* is a trace of the voltage across a detonator and point A is the time of fire pulse. FIG. 5*b* is a trace of the fuze doppler signal and point B designates the optimum time to cause the fire pulse. Point C on FIG. 5*c* shows the time the fuze locked onto a target and point D indicates that the lock was maintained until after the fire pulse was generated.

A common time base, FIG. 5*d*, such as the Inter Range Instrumentation Group (IRIG), is used to tie all the events together and see their correlation. The time base can also be recorded on other data collecting devices, such as cameras, and used to correlate all of the data taken at various locations during a test.

In FIG. 5, the time interval between points F and G on the IRIG time base is 10 milliseconds. By showing the complete encounter in FIG. 5, the resolution is not sufficient to determine the actual time interval between events at the time the fire pulse was generated. Accordingly, FIG. 6 was made by expanding the time base and looking in the region of the fire pulse. In FIG. 6, the time interval between points F and G is 1 millisecond.

Referring to the lock and fire command data shown in FIGS. 5 and 6, the fire command pulse C is generated and, almost simultaneously, the fire pulse A occurs. Point B on the doppler graph is the start of the transient and the fuze does not lose lock until point D, as shown in the lock and fire command data. Accordingly, it can be determined whether or not the fuze functioned in the proper sequence and at the optimum time for maximizing target kill for the fuze-target closing velocity.

OPERATION

In operation, simulated target 16 is loaded into gun 23 in a manner similar to the loading of a projectile into a gun and a power charge is added to provide a desired muzzle velocity. Rotating band 18 serves the same function on simulated target 16 that a rotating band serves on a projectile body, that is, the rotating band functions to seal the bore of the gun, positions and centers the rear end of the simulated target and imparts rotation to the simulated target.

One or more fuzes and/or fuzed warheads to be tested are position on one or more towers 15 and the confirmation radar and fuzes are electrically connected with the recorders in housing 27. Cameras 26 and the tape recorders in housing 27 are started prior to launching simulated target 16 so that a full record of the flight and reactions thereto will be made.

By way of example, the following uses may be made of the test range shown in FIG. 3 of the drawings:

a. Non-destructive testing of fuzes being developed to check prototypes and determine parameters;

b. Non-destructive testing of production fuzes for checking quality control;

c. Testing of fuzes in an environment of countermeasures wherein devices either in the simulated target or stationarily mounted devices are attempting to confuse or jam the fuze;

d. Non-destructive testing of old items to determine the effects of age;

e. Non-destructive testing of fuzes to determine limits of target approach angle;

f. Non-destructive testing of fuzes to determine target detection distance; and g. Destructive testing of warheads to determine fragmentation pattern and kill probability.

Other uses of the test range will become apparent to those skilled in the art. For example, a flare might be carried by simulated target 16 and an IR fuze could be mounted on a tower to determine its ability to detect and fire properly.

In all non-destructive tests, the fuze will be available for examination in case of a failure, as opposed to the present method of shooting at a drone wherein a miss does not provide any information as to why the fuze either did not operate or, if operated, there was a failure to hit the target. In addition, a permanent record will be provided showing the flight path of the simulated target and the reaction of fuze or fuzed warhead thereto.

Obviously many modifications and variations of the present invention are possible in the light of the above-teachings. It is therefore to be understood that within the scope of the appended claims the invention may be practiced otherwise than as specifically described.

I claim:

1. A method of testing air target fuzing systems comprising the steps of, first stationarily mounting at least one fuzing device to be tested, next firing a simulated target past said fuzing device, and then recording the reaction between said fuzing device and said simulated target when said simulated target is encountered by said fuze.

2. A method of testing air target fuzing systems as set forth in claim 1 wherein said simulated target and said fuzing device have a closing velocity between 3000 feet per second and 6000 feet per second.

3. A method of testing air target fuzing systems as set forth in claim 1 wherein said simulated target is fired from a suitable Naval gun.

4. A method of testing air target fuzing systems as set forth in claim 1 wherein said simulated target is provided with a rocket motor for providing increased closing velocity for said simulated target.

5. A method of testing air target fuzing systems as set forth in claim 1 wherein a plurality of fuzing devices to be tested are deployed in a pattern within encountering range of a flight path of a simulated target whereby a plurality of fuzing devices can be simultaneously tested by firing a single simulated target.

6. A method of testing air target fuzing systems as set forth in claim 1 wherein the reaction between said fuzing device and said simulated target when said simulated target is encountered by said fuze is recorded on film by cameras and on magnetic tape by recorders.

7. A method of testing air target fuzing systems as set forth in claim 1 wherein said simulated target is tracked by a radar to confirm that said simulated target presents an adequate target for said fuzing device.

8. A method of testing air target fuzing systems as set forth in claim 1 wherein said at least one fuzing device is mounted on a tower and said simulated target is fired from a gun and passes said tower at a height above said tower.

9. A method of testing air target fuzing systems as set forth in claim 1 wherein said simulated target is provided with a reflective device to enhance detection by said fuzing device.

10. A method of testing air target fuzing systems as set forth in claim 9 wherein said reflective device is a Luneburg lens.

11. A system for testing proximity fuzes comprising, means for supporting a proximity fuze in a test position, a simulated target, means for firing said simulated target past said fuze along a predetermined path within the field of sensitivity of said fuze and at a velocity which approximates an in-service target-fuze closing velocity, and time correlated means for measuring and recording the performance of said fuze in response to its in-passing encounter with said simulated target.

12. A system as in claim 11 wherein said simulated target is a gun-fired shell supported lens of a Luneberg type.

13. A system as in claim 11 wherein said fuze has an in-service velocity of $Vp$, said target has an in-service velocity of $Vt$, said target and fuze have an in-service closing velocity of $Vc = Vt + Vp$, and said simulated target has a velocity $Vt = Vc$ where said test fuze has the velocity $Vp = 0$.

14. A system as in claim 13 wherein the velocity of said simulated target ranges between 3000 to 6000 feet per second.

15. A system as in claim 11 wherein said time correlated means comprises at last one camera to photograph said encounter and at least one magnetic recorder connected to at least one component of the fuze to measure its performance, and wherein film in said camera and tape in said recorder have markings thereon to time correlte the occurrences of the same events recorded on both said film and tape and to show the time separation between the occurrences of events recorded separately on each.

* * * * *